United States Patent [19]

Brown

[11] 4,196,433

[45] Apr. 1, 1980

[54] DOPPLER FREQUENCY PROXIMITY FUZE

[75] Inventor: Charles B. Brown, Kensington, Md.

[73] Assignee: The United States of America as represented by the Secretary of the Navy, Washington, D.C.

[21] Appl. No.: 861,724

[22] Filed: Dec. 23, 1959

Related U.S. Application Data

[63] Continuation-in-part of Ser. No. 567,036, Feb. 21, 1956, abandoned.

[51] Int. Cl.[2] ..... F42C 13/04

[52] U.S. Cl. ..... 343/6 R; 343/7 PF

[58] Field of Search ..... 343/6 R, 7 PF

[56] References Cited

U.S. PATENT DOCUMENTS

| | | | |
|---|---|---|---|
| 2,413,263 | 12/1946 | Suter | 33/17 R |
| 2,491,542 | 12/1949 | Woodyard | 34/8 |
| 2,913,716 | 11/1952 | Powell | 343/7 PF |

*Primary Examiner*—T. H. Tubbesing

*Attorney, Agent, or Firm*—R. S. Sciascia; A. L. Branning

EXEMPLARY CLAIM

1. An apparatus for preselecting the Doppler frequency response of a proximity fuze comprising, in combination, radar means for determining the relative velocity between a selected target and a proximity fuze and for developing a predetermined control current correlative to this information, tunable amplifier means in the proximity fuze discretely responsive to said control current and adapted to render the proximity fuze selectively responsive to the determined relative velocity between the selected target and the proximity fuze, a conductive sleeve on the proximity fuze electrically connected to said tunable amplifier, and contact means detachably abutting said sleeve and electrically connected to said radar means for applying said control current to the fuze prior to the firing thereof at the selected target.

1 Claim, 3 Drawing Figures

DOPPLER FREQUENCY PROXIMITY FUZE

The invention described herein may be manufactured and used by or for the Government of the United States of America for governmental purposes without the payment of any royalties thereon or therefor.

This application is a continuation-in-part of the application of Charles B. Brown, Ser. No. 567,036, filed Feb. 21, 1956, now abandoned.

This invention relates generally to a proximity fuze for an ordnance projectile or the like, and more particularly to a proximity fuze having a preset firing frequency characteristic.

Existing proximity fuzes generally utilize the Doppler signal resulting from the relative motion between the fuze, or projectile, and the target to actuate the fuze on close approach to the target. A typical proximity fuze generally consists of an antenna, an oscillator-detector circuit, an audio amplifier circuit, and a thyratron firing circuit. The oscillator generates and radiates an electromagnetic wave, part of which is intercepted by the target and reflected back to the fuze antenna, whereupon a ripple, or beat, signal is developed in the oscillator-detector proportional to the relative velocity between the target and the fuze. The ripple signal is amplified by the audio amplifier and the amplified signal fed to a thyratron firing circuit. When the amplitude of the amplified signal exceeds the initiation potential of the thyratron, an electrical storage device is discharged through a primer device thereby detonating the fuze.

A significant disadvantage of the aforedescribed proximity fuze lays in its susceptibility to interference from electromagnetic wave reflections caused by objects other than the target whereupon fuze detonation occurs at a position other than the "optimum burst point". This shortcoming exists because of the broad frequency response requirement of the audio amplifier necessitated by the large variations in the ripple frequency resulting from the variety of relative velocities between the fuze and different targets; i.e., planes, missiles, etc.

Accordingly, one object of the present invention is to provide a new and improved proximity fuze which obviates the disadvantages of the prior art proximity fuzes hereinabove described.

Another object of the present invention is to provide a new and improved ripple frequency selective proximity fuze.

A further object of the present invention is to provide a new and improved arrangement for presetting the ripple frequency response of a proximity fuze.

A still further object of the present invention is to provide a new and improved proximity fuze having a shiftable ripple frequency response.

Other objects and many of the attendant advantages of the present invention will be readily appreciated as the same becomes better understood by reference to the following detailed description when considered in connection with the accompanying drawing wherein.

Figure 1:
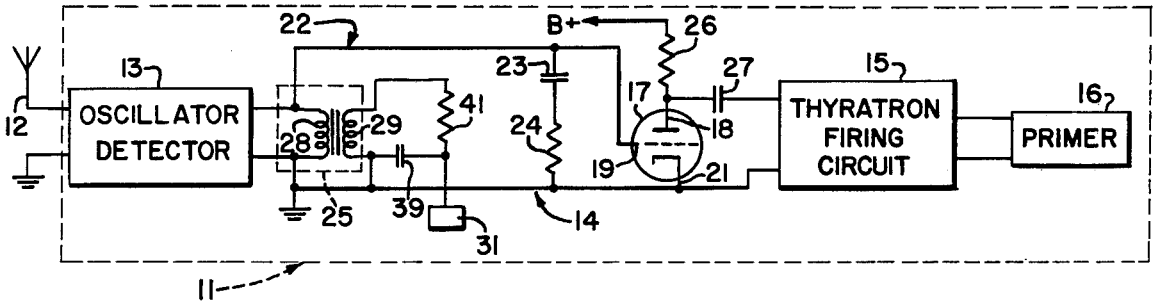
FIG. 1 is a diagrammatic view illustrating the circuit components of the improved proximity fuze of the present invention.

Referring now to the drawing wherein like reference numerals indicate like parts throughout the several views and more particularly to FIG. 1 thereof, whereon is shown the proximity fuze of the present invention, generally indicated by the reference numeral 11, said proximity fuze consisting of an antenna 12 for radiating the electromagnetic waves generated by the oscillator-detector circuit 13 into space. Impingement of this wave on any suitable surface, including the target surface, results in a reflection of a portion of the radiated wave back to the fuze antenna 12 whereupon it is mixed with the generated wave in the oscillator-detector circuit 13 thereby producing a beat, or ripple, frequency output signal for amplification by an audio amplifier, generally indicated by the numeral 14. The amplified output of amplifier 14 is connected to a thyratron firing circuit 15 which is adapted to discharge a charged capacitor through a primer 16 when the amplitude of the amplified signal exceeds a predetermined value, i.e., thyratron breakdown potential, thereby detonating the fuze 11 a predetermined lethal distance from the target. Unlike the broad pass band characteristic of audio amplifiers utilized in existing proximity fuzes, the audio amplifier 14 of the subject proximity fuze has a narrow pass band characteristic tunable to be responsive to the anticipated ripple frequency developed from the target reflected wave alone, as will hereinafter be described. As shown, audio amplifier circuit 14 consists of a vacuum tube 17, which, for purposes of explanation and not by way of limitation, is represented as a triode having plate, grid, and cathode electrodes 18, 19 and 21, respectively. Connected in a conventional manner across the grid and cathode electrodes 19 and 21 is a tuned input circuit, generally indicated by the reference numeral 22, and comprising a capacitor 23, resistor 24, and a saturable core reactor, or transductor, 25 for selectively varying the resonant frequency of tuned circuit 22. The plate electrode 18 is connected to the B+ supply via dropping resistor 26 and to the thyratron firing circuit 15 through a coupling capacitor 27.

The response of tuned circuit 22 is controlled and varied by the variations in the inductance of winding 28 of transducer 25 resulting from the unidirectional control current applied to winding 29 of the transducer through control terminal 31. As is well known in the art, the application of direct current to control winding 29 results in a proportionate reduction in the inductance of load winding 28 of the transductor 25 thereby resulting in a shift of the resonant frequency of the tuned tank circuit 22 and the response of audio amplifier 14. The values of capacitor 23, resistor 24 and the inductance of winding 28 are selected to form a tuned circuit having a sufficient narrow pass band response to pass the ripple frequencies resulting from the Doppler frequency variations corresponding to the relative velocity changes existing between a fuze and a particular target.

Figure 2:
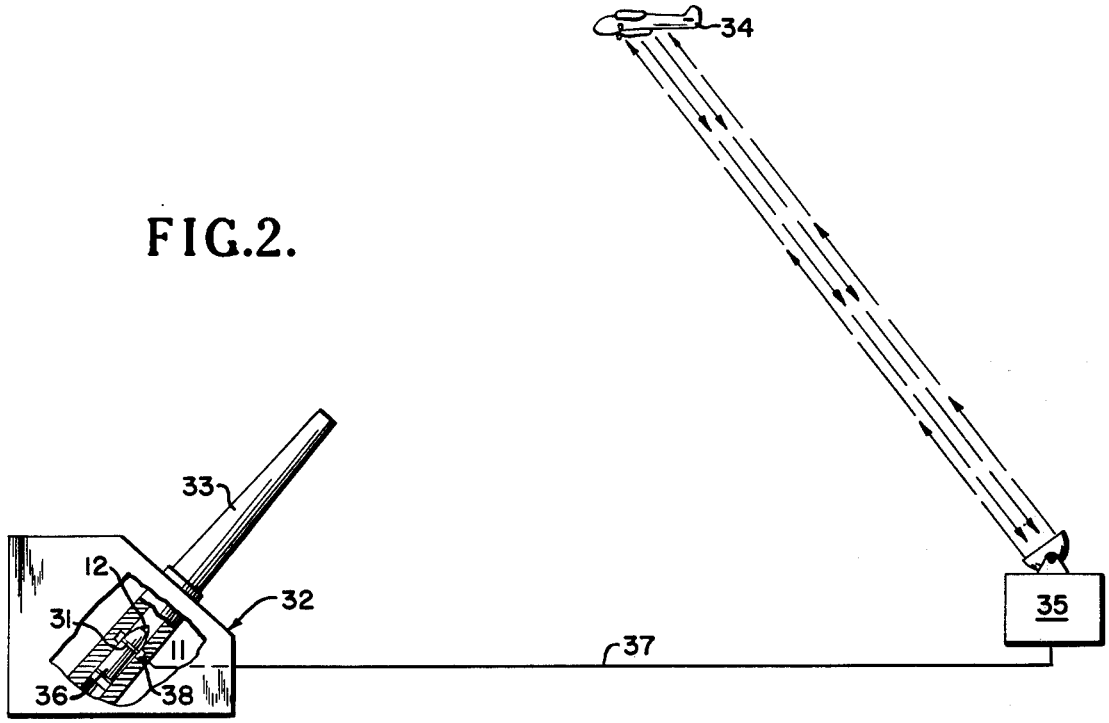
FIG. 2 is a view showing the overall arrangement for presetting the ripple frequency response of a proximity fuze.

Referring to FIG. 2, there is shown thereon a fuze presetting arrangement consisting of a gun, generally indicated by the reference numeral 32 having a barrel 33, a target, represented by the aircraft 34, and a conventional fire control radar computer 35 for continuously determining the course, range and speed of target 34 and, additionally, for developing a unidirectional control current corresponding to this information. Disposed within the breech of gun barrel 33 is an ordnance projectile, or missile, 36 having a proximity fuze 11 of the present invention secured thereto. The control current developed by the radar computer is applied to the proximity fuze 11 through an interconnecting circuit consisting of conductor 37, wiper contacts 38 appropriately attached within the breech of barrel 33 to make contact with a conductive sleeve, or control terminal, 31 of the transductor 25 in the audio amplifier circuit 14 immediately prior to the firing of projectile 36 at the target 34. The magnitude of the control current developed by the radar computer 35 is such as to render the audio amplifier 14 selectively responsive to the band of ripple frequencies to be anticipated as existing between the projectile 36 path and the aircraft, or target 34. A capacitor 39 is provided across winding 29 for storing the unidirectional control current applied to terminal 31. Resistor 41 is serially interposed between capacitor 39 and winding 29 for controlling the discharge rate of capacitor 39 through transductor winding 29.

Figure 3:
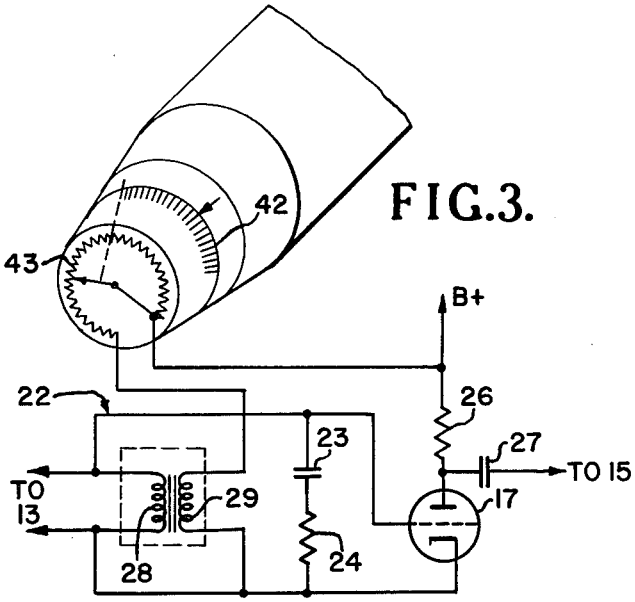
FIG. 3 is a diagrammatic view of an alternative arrangement of the tuned amplifier circuit of the proximity fuze of FIG. 1.

Although the response of the audio amplifier 14 is shown as being shiftable by the direct application of a control current developed by the radar computer 35 to the transductor control winding 29, through sleeve, or ring 31, it will be understood that this tuning may be accomplished differently, for example, by adjustment of a conventional rotatable setting ring 42 affixed to the proximity fuze adapted to vary a resistor 43 electrically interposed between the control winding 29 and a unidirectional current source, such as a battery B+, disposed within the proximity fuze 11, FIG. 3.

In summary, it should now be apparent that the proximity fuze of the present invention provides an arrangement wherein fuze actuation is substantially dependent upon the target developed Doppler effect and substantially insensitive to interference from extraneous reflections and noises. Moreover, it should also be apparent that the system of the present invention provides an arrangement in which it is possible to control the fuze actuation point in accordance with the most recent information available in regard to position, speed, and the like, of a target.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. An apparatus for preselecting the Doppler frequency response of a proximity fuze comprising, in combination, radar means for determining the relative velocity between a selected target and a proximity fuze and for developing a predetermined control current correlative to this information, tunable amplifier means in the proximity fuze discretely responsive to said control current and adapted to render the proximity fuze selectively responsive to the determined relative velocity between the selected target and the proximity fuse, a conductive sleeve on the proximity fuze electrically connected to said tunable amplifier, and contact means detachably abutting said sleeve and electrically connected to said radar means for applying said control current to the fuze prior to the firing thereof at the selected target.

* * * * *